US005127469A

United States Patent [19]

Boula

[11] Patent Number: 5,127,469

[45] Date of Patent: Jul. 7, 1992

[54] DEVICE FOR THE ANTI-VIBRATORY WEDGING OF TUBES OF A HEAT EXCHANGER

[75] Inventor: Gérard Boula, Corpeau, France

[73] Assignee: Framatome, Courbevoie, France

[21] Appl. No.: 731,270

[22] Filed: Jul. 17, 1991

[30] Foreign Application Priority Data

Jul. 20, 1990 [FR] France ..... 90 09331

[51] Int. Cl.[5] ..... F28D 7/06; F22B 37/24

[52] U.S. Cl. ..... 165/69; 165/162; 122/510

[58] Field of Search ..... 165/69, 162; 122/510

[56] References Cited

U.S. PATENT DOCUMENTS

| | | | |
|---|---|---|---|
| 3,007,697 | 11/1961 | Byerley et al. | 165/69 |
| 3,026,858 | 3/1962 | Fleischer | 122/510 |
| 3,212,567 | 10/1965 | Romanos | 165/69 |
| 3,575,236 | 4/1971 | Romanos | 165/162 |
| 4,128,221 | 12/1978 | Straffi | 165/162 |
| 4,286,366 | 9/1981 | Vinyard | 165/162 |
| 4,718,479 | 1/1988 | Lagally et al. | 165/69 |
| 5,005,637 | 4/1991 | Gentry | 165/69 |

FOREIGN PATENT DOCUMENTS

| | | |
|---|---|---|
| 0214812 | 3/1987 | European Pat. Off. . |
| 494367 | 9/1970 | Switzerland . |

*Primary Examiner*—John Rivell
*Assistant Examiner*—L. R. Leo
*Attorney, Agent, or Firm*—Pollock, Vande Sande & Priddy

[57] ABSTRACT

The anti-vibration bars are arranged as a plurality of sets of at least two bars (18, 18*b*), the outer ends of the bars being axially aligned. The outer end parts of the anti-vibration bars have aligned passage orifices (23, 24). The orifice (24) is internally threaded. The ends of the bars are connected by a spindle (20) which is threaded at one of its ends and has a screwing and unscrewing head (20*b*) at its other end. The spindle (920) is introduced into the aligned orifices (23, 24) and into the bore of a tubular spacer (21) interposed between the anti-vibration bars. After being screwed into the internally threaded orifice (24), the spindle (20) is blocked against rotation.

5 Claims, 3 Drawing Sheets

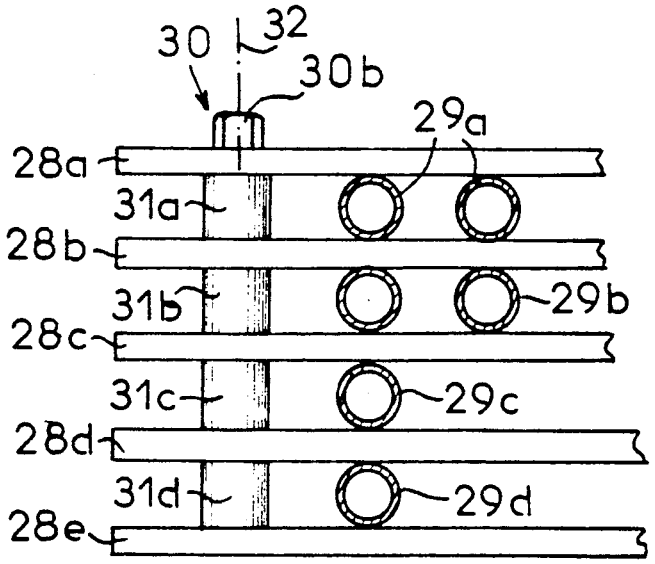
FIG. 4
FIG.5
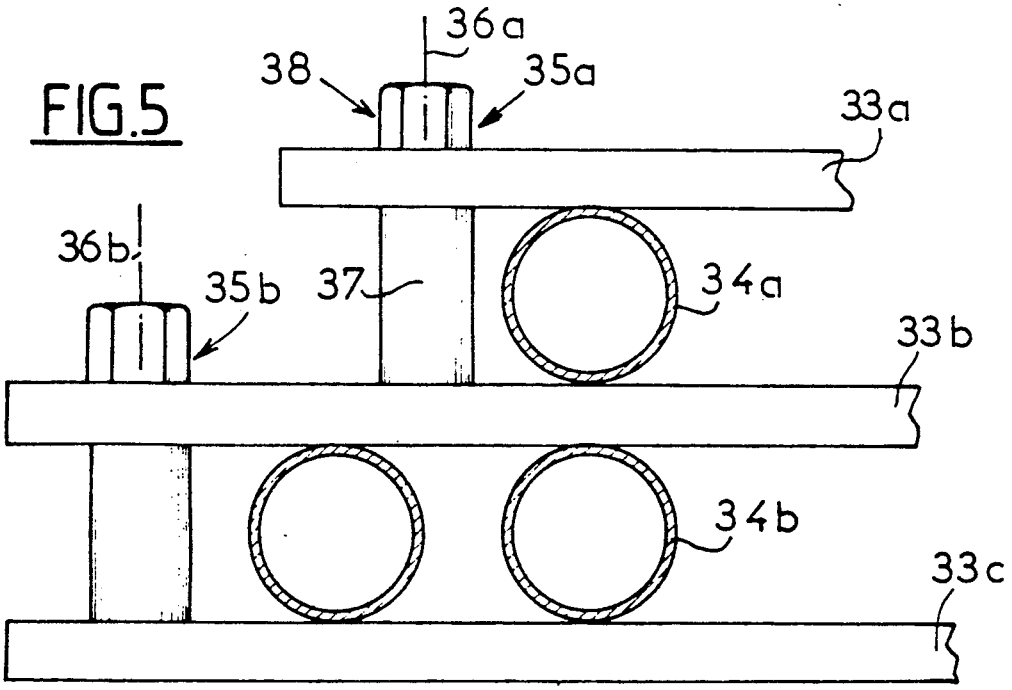

DEVICE FOR THE ANTI-VIBRATORY WEDGING OF TUBES OF A HEAT EXCHANGER

FIELD OF THE INVENTION

The invention relates to a device for the anti-vibratory wedging of tubes of a heat exchanger, such as a steam generator.

BACKGROUND OF THE INVENTION

Steam generators, especially steam generators of pressurized-water nuclear reactors, comprise tubes bent in the form of a U and having two branches crimped at their ends in a tube plate. The tubes are arranged according to adjacent plane layers. The curved parts of the tubes of the bundle which are juxtaposed in its upper part have radii of curvature different from one another and are placed mutually adjacent to form a structure of substantially hemispherical form, called a bun.

While the steam generator is in operation, pressurized water at high temperatures circulates in the tubes of the bundle and feed water is brought in contact with the outer surface of these tubes, along which it travels in the vertical direction, at the same time heating up and then evaporating, in order to re-emerge in the form of steam in the upper part of the generator.

The circulation of the fluid in contact with the tubes can give rise to vibrations which are liable to cause damage to these tubes if they are not held effectively.

The straight part of the tubes is engaged in spacers arranged at uniform distances from one another over the height of the bundles. These straight parts are therefore held effectively by rigid elements. The curved parts of the tubes of the bundle forming the bun must likewise be held, and this purpose is generally served by the use of spacer bars which are each interposed between two layers of adjacent tubes of the bundle and which are arranged in substantially radial directions of the bun. These spacer bars are usually connected two by two in an articulated manner at one of their ends located towards the inside of the bun and are placed angularly so as to form V-shaped structures.

The outer ends of the anti-vibration bars opposite their articulated ends project relative to the tubes forming the outer layer of the bun and are connected to one another by connection means ensuring retention of the anti-vibration bars.

Various means for connecting the outer ends of the anti-vibration bars, using fastening elements placed on the upper surface of the bun, have been proposed.

It has been proposed, for example, to weld the ends of the anti-vibration bars to curved elements arranged along mid-planes of the bun.

It has also been proposed to fasten the ends of the anti-vibration bars, for example by welding, to substantially parallel hoops resting on the upper surface of the bun. At all events, the fastening of the anti-vibration bars requires complex operations most often employing welds which have to be made in the vicinity of the tubes of the bundle which thus risk suffering some damage. Moreover, the component materials of the anti-vibration bars must be selected to allow their welding and, if appropriate, their treatment after welding, under good metallurgical conditions.

There have also been provided mechanical connection devices making it possible to connect the outer ends of the anti-vibration bars to fastening pieces, such as retaining hoops resting on the outer surface of the bun.

These devices are relatively complex and, for fastening them, require the use of heavy and bulky complementary elements attached to the bun. Furthermore, these devices do not make it possible to ensure exact alignment of the anti-vibration bars and to adjust accurately the play present between two successive anti-vibration bars, between which a layer of tubes is interposed.

SUMMARY OF THE INVENTION

The object of the invention is, therefore, to provide a device for the anti-vibratory wedging of tubes of a steam generator comprising a bundle of tubes which are bent in the form of a U, fastened at their ends in a tube plate and arranged according to adjacent layers and the bent parts of which, opposite the tube plate and juxtaposed, form an assembly of substantially hemispherical form, called a bun, the wedging device comprising a set of anti-vibration bars each interposed between the bent parts of two adjacent layers of tubes of the bundle and arranged in a substantially radial direction of the bun, so as to have one end on the outside of the bun, and an assembly of connection means between the outer end parts of the anti-vibration bars, this wedging device having a small bulk, being very quick and very easy to install both in a new steam generator produced at the factory and in a worn steam generator during maintenance and repair, and making it possible to ensure exact alignment and accurate adjustment of the spacing of the anti-vibration bars.

To this end, the outer ends of the anti-vibration bars arranged as a plurality of sets of at least two bars, in which the bars are aligned, have aligned passage orifices, one of which is internally threaded, a means for connecting the ends of the anti-vibration bars is associated with each of the sets of bars, and each of the connection means consists of a spindle threaded at one of its ends and with a screwing and unscrewing head at its opposite end, and at least one tubular spacer the length of which corresponds substantially to the diameter of the tubes of a layer, the spindle being introduced into the aligned orifices of a set of anti-vibration bars and into the bore of at least one spacer interposed between two anti-vibration bars, being screwed into the internally threaded orifice and being blocked by a means for blocking against rotation.

BRIEF DESCRIPTION OF THE DRAWINGS

In order that the invention may be more clearly understood, an embodiment of a wedging device according to the invention used in a steam generator of a pressurized-water nuclear reactor will now be described by way of example with reference to the accompanying drawings.

FIG. 4 is a view similar to FIG. 3 and relating to a second embodiment of a wedging device according to the invention.

FIG. 5 is a view similar to FIG. 3 and relating to a third embodiment of a wedging device according to the invention.

DETAILED DESCRIPTION

Figure 1:
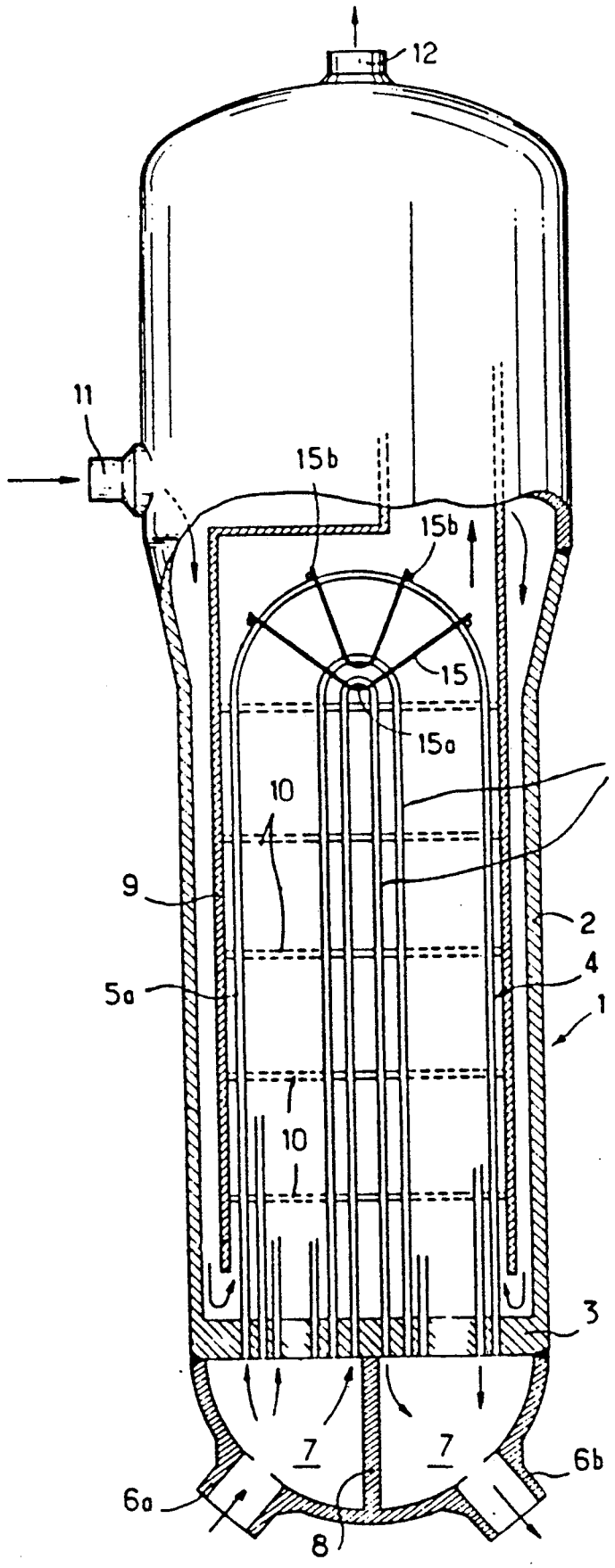
FIG. 1 is a partially sectional elevation view of a steam generator of a pressurized-water nuclear reactor comprising anti-vibration bars for holding the tubes of the bundle.

FIG. 1 shows a steam generator of a pressurized-water nuclear reactor 1 comprising an outer casing 2 connected in its lower part to a tube plate 3 of great thickness.

The casing 2 contains the bundle of tubes of the steam generator, consisting of tubes 5 bent in the form of a U and having in their upper part semi-circular bends forming the bun of the steam generator.

The straight parts 5*a* of the tubes of the bundle are crimped at their ends in the tube plate 3, so as to open into a water box 7 in two parts separated by a partition 8.

The pressurized water of the nuclear reactor enters one of the parts of the water box 7 via an inlet connection 6*a*, circulates in the tubes of the bundle and then re-emerges via an outer connection 6*b*.

The tube bundle 5 is surrounded by a bundle casing 9 making it possible to channel the feed water entering the casing of the steam generator via an intake connection 11. The feed water of the steam generator circulates first from the top downwards in the annular space located around the bundle casing 9 and then from the bottom upwards in contact with the tubes 5 of the bundle, so as to heat up, then evaporate and re-emerge in the form of steam via the upper connection 12 of the steam generator.

The upper part of the tube bundle, called the bun, consists of the juxtaposition of bends of semicircular form arranged according to successive layers, in which the radii of the bends decrease from the outside towards the inside of the bundle.

Moreover, the various successive layers of tubes of the bundle which are parallel to the central layer shown in FIG. 1 comprise outer bends of decreasing diameters, with the result that the upper part of the bundle, or bun, forms an assembly of substantially hemispherical form.

The straight part 5*a* of the tubes 5 is held by spacer plates 10 which, when the steam generator is in operation, prevent the tubes from vibrating under the effect of the circulation of the exchange fluids.

The bent parts of the tubes located at the upper end of the bundle are held by anti-vibration bars 15 taking the form of compasses articulated at their inner end 15*a* and introduced between the successive layers of tubes and level with the bends.

The outer ends 15*b* of the branches of the anti-vibration bars project relative to the upper surface of the bun and make it possible to carry out the fastening of the anti-vibration bars.

Anti-vibration bars will hereafter denote any branch of a compass-shaped assembly 15.

Figure 2:
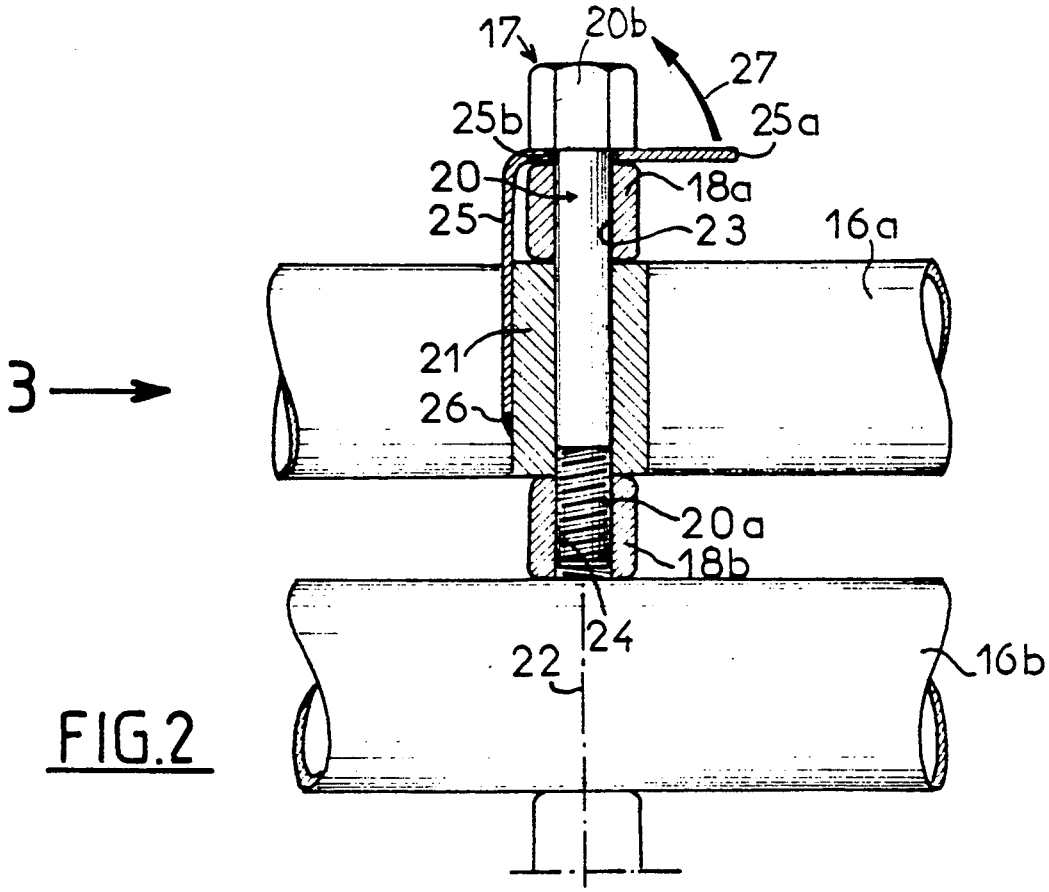
FIG. 2 is a sectional view of a wedging device according to the invention in its part located above the bun of the steam generator.

FIG. 2 illustrates a portion of the bent part of two tubes 16*a* and 16*b* of the bundle of the steam generator, which are arranged in two adjacent layers and which are located in the outer part of these layers. The outer tubes such as 16*a* and 16*b*, of the successive layers of the bundle of the steam generator, define the outer surface of the bun of hemispherical form.

Figure 3:
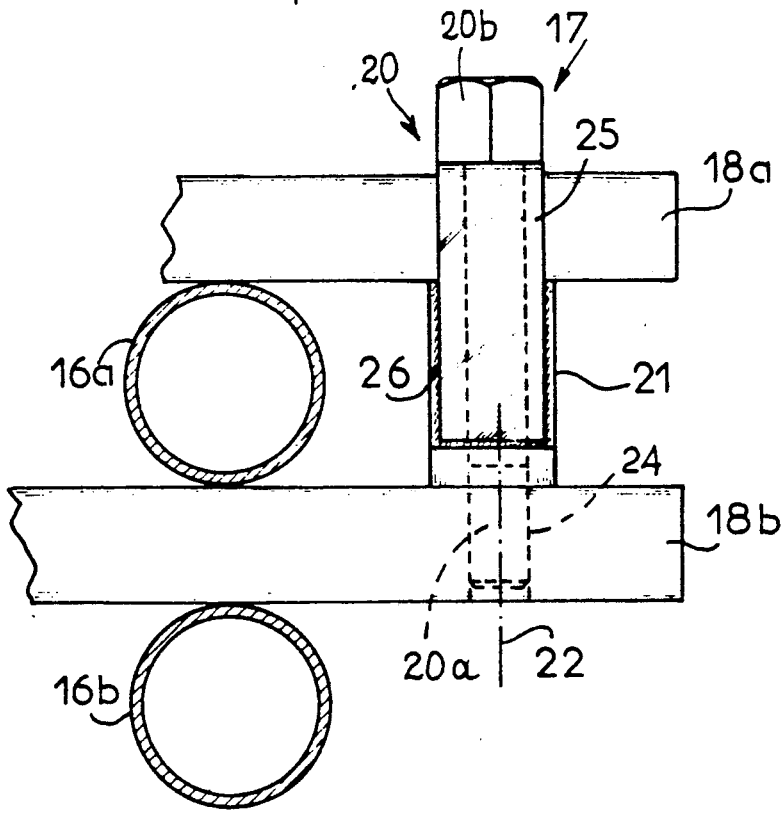
FIG. 3 is a view in the direction of arrow 3 in FIG. 2.

FIGS. 2 and 3 also show an element 17 of an anti-vibratory wedging device according to the invention which is arranged in the bun of the steam generator.

The element 17 of the wedging device comprises a first anti-vibration bar 18*a* interposed between the layer of tubes in which the tube 16*a* is arranged and an adjacent layer of tubes, a second anti-vibration bar 18*b* interposed between the layer of tubes in which the tube 16*a* is arranged and the adjacent layer of tubes in which the tube 16*b* is arranged, a connecting spindle 20 and a spacer 21.

The anti-vibration bars 18*a* and 18*b* are placed in positions aligned along an axis 22 perpendicular to the axis of the tubes 16*a* and 16*b*.

According to the invention, the end parts of the anti-vibration bars 18*a* and 18*b* remaining projecting on the outside of the bun, i.e., relative to the tubes 16*a* and 16*b*, after they have been installed in the bun, have cylindrical passage orifices 23 and 24, the axis of which is the axis of alignment 22 of the two anti-vibration bars 18*a* and 18*b*.

The orifice 23 is a smooth cylindrical orifice, whereas the orifice 24 is internally threaded so as to allow the screwing in of a threaded part 20*a* of the spindle 20.

The end of the spindle 20 opposite its threaded end 20*a* forms a head 20*b*, the cross-section of which can, for example, be of hexagonal form. The head 20*b* makes it possible to carry out the screwing and unscrewing of the spindle 20 by the use of a suitable tool.

The spacer 21 is of tubular form, the bore of this spacer having a diameter substantially equal to the diameter of the orifices 23 and 24.

A tab 25 cut out from a steel sheet or strip is fastened by means of a peripheral welding line 26 to the outer surface of the spacer 21. The tab 25 can be welded to the spacer 21 by the TIG method.

The length of the spacer 21 in the axial direction is equal to the mean diameter of the tubes forming the layer in which the tube 16*a* is arranged.

To carry out the installation and assembly of the element 17 of the anti-vibratory wedging device according to the invention, the installation of the anti-vibration bars 18*a* and 18*b* in the bun of the steam generator is executed in the first place, as in the prior art. The ends of the anti-vibration bars 18*a* and 18*b* having the orifices 23 and 24 remain projecting on the outside of the bun of the steam generator after the installation of the anti-vibration bars.

The anti-vibration bars 18*a* and 18*b*, especially their projecting end parts, are placed in alignment with one another in the direction 22 perpendicular to the axis of the tubes 16*a* and 16*b*.

The orifices 23 and 24 are then aligned in such a way that the axis 22 constitutes their common axis. The spacer 21 is interposed between the anti-vibration bars 18*a* and 18*b*, the bore of this tubular spacer being placed in alignment with the orifices 23 and 24.

The stop tab 25 bent at 90° has a turned-down part 25*a*, through which passes an orifice 25*b* arranged in alignment with the orifice 23.

The spindle 20 is introduced into the orifices 25*b* and 23 and into the bore of the spacer 21 and is then screwed into the internally threaded orifice 24 of the spacer 18*b* by the use of a tightening tool.

The spindle 20 makes the connection between the end parts of the anti-vibration bars 18*a* and 18*b* and ensures the clamping of these anti-vibration bars on the end surfaces of the spacer 21, the length of which corresponds to the mean diameter of the tubes of the layer having the tube 16*a*. The spacing of the anti-vibration bars 18*a* and 18*b* is thus set at a value making it possible to optimize the conditions of the anti-vibratory wedging of the tubes of the layer having the tube 16*a*.

After the spindle 20 has been tightened, it can be blocked against rotation by turning the end of the part 25*a* of the tab 25 down onto the head 20*b* of the spindle, as indicated by the arrow 27. Thus, the spindle 20 is incapable of slackening, and the elements for connecting the anti-vibration bars 18*a* and 18*b* are not liable to work loose under the effect of the vibrations in the steam generator during operation.

It is clear that the ends of the various anti-vibration bars introduced into the bun of the steam generator can be connected in pairs by means of devices, such as the device 17 illustrated in FIGS. 2 and 3.

The entire device of the anti-vibratory wedging of the bundle tubes arranged in the bun is thus kept perfectly in place and ensures effective wedging of the various layers of tubes in their bent part.

FIG. 4 shows a set of anti-vibration bars 28*a*, 28*b*, 28*c*, 28*d* and 28*e* aligned in a direction 32 perpendicular to the axes of the tubes 29*a*, 29*b*, 29*c* and 29*d* forming successive layers of tubes interposed between the anti-vibration bars.

The aligned anti-vibration bars 28*a* to 28*e* have a part projecting relative to the tubes 29*a*, 29*b*, etc. located furthest towards to the outside in the successive layers of tubes.

In these projecting parts, orifices of which the common axis is the axis 32 pass through the anti-vibration bars 28*a* to 28*e*.

The aligned orifices passing through the anti-vibration bars consist of smooth holes, with the exception of the orifice passing through the last anti-vibration bar of the row (the bar 28*e* in FIG. 4), which consists of an internally threaded hole.

After they have been installed in the bun of the steam generator, the anti-vibration bars 28*a* to 28*e* are connected to one another by their projecting end part by means of a spindle 30 introduced into the aligned orifices of the anti-vibration bars and into the bores of the spacers 31*a*, 31*b*, 31*c* and 31*d* arranged between the successive anti-vibration bars 28*a* to 28*e*.

The spindle 30 has a threaded end which is screwed into the internally threaded hole of the anti-vibration bar 28*e*, so as to make the connection between the anti-vibration bars and ensure the clamping of these anti-vibration bars against the spacers. The spindle 30 has a head 30*b* making it possible to carry out screwing and, where appropriate, unscrewing of the spindle 30.

The spacers 31*a*, 31*b*, 31*c* and 31*d* have a length in the axial direction 32 which is equal to the mean diameter of the tubes 29*a*, 29*b*, 29*c* and 29*d* forming the successive layers of tubes held by the anti-vibration bars 28*a* to 28*e*.

A single operation thus ensures perfect alignment of a row of anti-vibration bars and installation of these anti-vibration bars on either side of the layers of tubes, with a spacing ensuring the best possible wedging of the tubes.

The spindle 30 can be blocked against rotation in an identical way to the blocking of the spindle 20 illustrated in FIG. 2. The spacer 31*a* located nearest the head 30*b* of the spindle 30 has a stop tab welded to its outer surface, this tab being turned down onto the head 30*b* after the spindle has been tightened.

FIG. 5 illustrates a third embodiment of elements of a wedging device according to the invention.

The ends of the anti-vibration bars 33*a*, 33*b* and 33*c* projecting relative to the tubes 34*a* and 34*b* located on the outside of successive layers of tubes are in offset positions as a result of the relative arrangement of the tubes 34*a* and 34*b* of the two successive layers.

The outer tube 34*a* of the first layer has a radius of curvature in the region of its bend which is smaller than the radius of curvature of the bent part of the tube 34*b*, these differences in radius of curvature occurring as a result of the geometry of the bun of the steam generator.

As a result, the projecting part of the anti-vibration bar 33*a* is set back relative to the projecting parts of the anti-vibration bars 33*b* and 33*c*.

In this case, the outer end parts of the anti-vibration bars 33*a*, 33*b* and 33*c* can be connected by connecting devices 35*a* and 35*b* similar to the devices 17 illustrated in FIG. 2 and 3.

A smooth orifice passes through the anti-vibration bar 33*a* and an internally threaded orifice through the bar 33*b*, these orifices having a common axis 36*a*. The device 35*a* comprising a spindle 38 and a spacer 37 makes it possible to obtain the connection between the end parts of the bars 33*a* and 33*b* aligned in the direction of the axis 36*a*.

The bar 33*b* likewise has a smooth orifice passing through it in its part located outwards in relation to the internally threaded orifice aligned along the axis 36*a*.

The bar 33*c* is pierced with an internally threaded orifice having the axis 36*b* as an axis common to the smooth orifice passing through the bar 33*b*. The device 35*b* comprising a spindle and a spacer makes it possible to ensure a connection between the bars 33*b* and 33*c*.

The advantage of the wedging device according to the invention is that it makes the connection between the anti-vibration bars interposed between the layers of tubes within the bun of the steam generator, without the need for welding. Any suitable material can therefore be used to form the anti-vibration bars which are not affected by the welding operations.

It is possible to adjust very accurately the spacing between the anti-vibration bars arranged on either side of a layer of tubes, this spacing being set at a value corresponding to the mean diameter of the tubes in the layer in question. In fact, this mean diameter of the tubes in a layer of the bundle of a steam generator is liable to vary, and therefore the use of spacers of variable length makes it possible to optimize the spacing of the anti-vibration bars. Furthermore, the device according to the invention makes it possible to ensure an exact alignment of the anti-vibration bars arranged in a row by the use of a connecting element consisting of a spindle introduced into aligned orifices of the anti-vibration bars.

The device according to the invention comprises elements for connection between the anti-vibration bars the volume of which is relatively small.

Finally, the device according to the invention makes it possible to carry out the wedging of the tubes with a spacing between the anti-vibration bars which is maintained at a set value.

Depending on the arrangement of the anti-vibration bars and on their number, it is possible to use spindles of great length which make the connection between the end parts of a large number of anti-vibration bars.

It is possible to use a spindle-blocking and retaining means other than a stop tab welded to the spacer located in the vicinity of the screwing and unscrewing head of this spindle.

Finally, the anti-vibratory wedging device according to the invention can be used in any heat exchanger comprising bent tubes arranged in parallel layers.

I claim:

1. Device for anti-vibratory wedging of tubes of a heat exchanger comprising a bundle of tubes which are bent in the form of a U, fastened at their ends in a tube plate and arranged according to parallel layers and bent parts of which, opposite the tube plate and juxtaposed, form an assembly of substantially hemispherical form, called a bun, the wedging device comprising a set of anti-vibration bars (18*a*, 18*b*, 28*a* to 28*e*, 33*a*, 33*b*, 33*c*) each interposed between the bent parts of two adjacent layers of tubes (16*a*, 16*b*, 29*a* to 29*d*, 34*a*, 34*b*) of the bundle and arranged in a substantially radial direction of the bun, so as to have one end on the outside of the bun, and an assembly of connection means between outer ends of the anti-vibration bars, wherein the outer ends of the anti-vibration bars (18*a*, 18*b*, 29*a* to 29*d*, 33*a*, 33*b*, 33*c*) arranged as a plurality of sets of at least two bars, in which the bars are aligned, have aligned passage orifices (23, 24), one of which is internally threaded, wherein means for connecting the outer ends of the anti-vibration bars is associated with each of the sets of bars, and wherein each of the connection means consists of a spindle (20, 30) having a threaded part (20*a*) at one of its ends and an end opposite the threaded part (20*a*) forming a screwing and unscrewing head (20*b*), and at least one tubular spacer (21, 31*a* to 31*d*, 37) having a length which corresponds substantially to a mean diameter of the tubes (16*a*, 29*a*, to 29*d*, 34*a*) of a layer of tubes, the spindle (20, 30, 38) being introduced into the aligned orifices of a set of anti-vibration bars and into the bore of at least one spacer interposed between two anti-vibration bars, being screwed into the internally threaded orifice and being blocked by means (25) for blocking against rotation.

2. Device according to claim 1, wherein the means for blocking the spindle (20) against rotation consists of a sheet-metal tab (25) welded to an outer surface of the spacer (21) located in a vicinity of the screwing and unscrewing head (25*b*) of the spindle (20) and having a part (25*a*), through which passes an orifice (25*b*), in which the spindle (20) is engaged, and which is adapted to be turned down onto the screwing and unscrewing head (20*b*) of the spindle (20).

3. Device according to claim 1 or 2, wherein at least one of the connection means comprises at least two spacers (31*a* to 31*d*), each interposed between two successive anti-vibration bars (28*a* to 28*e*), the spacers (31*a* to 31*d*) having different lengths corresponding to the mean diameter of the tubes in the layers of tubes (29*a* to 29*d*) between which the anti-vibration bars (28*a* to 28*e*) are interposed.

4. Device according to claim 1 or 2, wherein the anti-vibration bars (33*a*, 33*b*, 33*c*) have outer ends offset in the radial direction of the bun, and wherein the connection means (35*a*, 35*b*) are arranged on corresponding anti-vibration bars (33*a*, 33*b*, 33*c*) in positions offset in the radial direction of the bun.

5. Device according to claim 1, wherein at least one of the sets of anti-vibration bars comprises a plurality of bars (28*a*, 28*b*, 28*c*, 28*d*, 28*e*) aligned in one direction (32), the anti-vibration bars (28*a* to 28*e*) forming the set being traversed by aligned smooth orifices along a common axis, which is arranged at the end of the set of aligned bars (28*a* to 28*e*) through which passes an internally threaded orifice.

* * * * *